US009290974B2

(12) United States Patent
Alexander

(10) Patent No.: US 9,290,974 B2
(45) Date of Patent: Mar. 22, 2016

(54) GEARED HINGE ASSEMBLY

(71) Applicant: Mark Alexander, Dowagiac, MI (US)

(72) Inventor: Mark Alexander, Dowagiac, MI (US)

(73) Assignee: SPECIAL-LITE INC., Decatur, MI (US)

( * ) Notice: Subject to any disclaimer, the term of this patent is extended or adjusted under 35 U.S.C. 154(b) by 0 days.

(21) Appl. No.: 14/619,225

(22) Filed: Feb. 11, 2015

(65) Prior Publication Data

US 2015/0252601 A1 Sep. 10, 2015

Related U.S. Application Data

(60) Provisional application No. 61/947,655, filed on Mar. 4, 2014.

(51) Int. Cl.

| | |
|---|---|
| ***E05D 3/12*** | (2006.01) |
| *E05D 11/00* | (2006.01) |
| *E05F 1/06* | (2006.01) |

(52) U.S. Cl.

CPC ..... *E05D 3/122* (2013.01); *E05D 11/0054* (2013.01); *E05D 2011/0072* (2013.01); *E05F 1/066* (2013.01); *Y10T 16/533* (2015.01); *Y10T 16/541* (2015.01)

(58) Field of Classification Search

CPC ... Y10T 16/541; Y10T 16/557; Y10T 16/533; Y10T 16/537; E05D 1/04; E05D 3/122; E05D 11/0054; E05D 2011/0072; E05Y 2900/132

USPC ..... 16/354, 386, 250, 273; 49/381, 386

See application file for complete search history.

(56) References Cited

U.S. PATENT DOCUMENTS

| | | | | |
|---|---|---|---|---|
| 3,402,422 | A | 9/1968 | Baer | |
| 4,976,008 | A | 12/1990 | Baer | |
| 4,996,739 | A | 3/1991 | Baer | |
| 4,999,878 | A | 3/1991 | Baer | |
| 4,999,880 | A | 3/1991 | Baer | |
| 5,001,810 | A | 3/1991 | Baer | |
| 5,062,181 | A | 11/1991 | Bobrowski et al. | |
| 5,201,902 | A | 4/1993 | Baer | |
| 5,337,451 | A | 8/1994 | Goossens | |
| RE35,618 | E | 10/1997 | Goossens | |
| 5,685,045 | A * | 11/1997 | Lace | E05D 3/122 16/354 |
| 5,778,491 | A | 7/1998 | Baer | |
| 6,073,310 | A | 6/2000 | Baer | |
| 6,170,210 | B1 | 1/2001 | Marts | |
| 7,063,042 | B2 | 6/2006 | Dillingham | |
| 2002/0035765 | A1 * | 3/2002 | Baer | E05D 3/122 16/354 |
| 2005/0091797 | A1 * | 5/2005 | Dillingham | E05D 3/122 16/354 |
| 2009/0313790 | A1 * | 12/2009 | Schau | E05D 3/122 16/354 |

OTHER PUBLICATIONS

Select Hinges™ "Toilet Partition Geared Continuous Hinges" (Installation Instructions) 2012 (4 pages).

* cited by examiner

*Primary Examiner* — William Miller

(74) *Attorney, Agent, or Firm* — Flynn, Thiel, Boutell & Tanis, P.C.

(57) ABSTRACT

A hinge device for a door is provided. The hinge device has two hinge members which engage with each other and a hinge cap. A bearing with one or more tapered ends engages with the hinge members to allow easy opening and closing of a door attached to the hinge device.

15 Claims, 7 Drawing Sheets

GEARED HINGE ASSEMBLY

CROSS-REFERENCE TO RELATED APPLICATIONS

This application claims the benefit of U.S. Provisional Application Ser. No. 61/947,655, filed Mar. 4, 2014, which is incorporated herein by reference in its entirety.

BACKGROUND OF THE INVENTION

The present invention generally relates to gear hinges and more specifically to gear hinge devices employing a bearing having an end edge which is not entirely perpendicular to the longitudinal axis of the hinge.

Because doors attached to a door frame with traditional pin-type hinges have their weight concentrated at a few relatively small areas where the hinges are located, continuous gear hinges are often preferable. Gear hinges usually extend the entire length of a hinge jamb or door, and thus distribute the weight of the door over a much larger area. For this reason, gear hinges are often installed on doors which see heavy use, such as those found in bathroom stalls.

A gear hinge typically has two opposing hinge members, each having a longitudinal leaf and a gear segment for meshing with an opposing gear segment, a hinge cap or clamp for holding the gear segments together so that one leaf can rotate relative to the other leaf while the gear segments remain meshed, and one or more bearing blocks for preventing one hinge member from shifting longitudinally relative to another hinge member. A gear hinge for a typical door will have several bearing blocks fitted into cutouts formed in the leaves and gear segments, and these bearing blocks, which are usually molded from plastic, carry essentially the entire weight of the door. As the hinge opens and closes, the ends of the cutouts in the gear segments slide over the end edges of the plastic bearing blocks, which can cause unwanted friction and wear over time. Plus, such doors with common gear hinges do not open or close automatically, without additional hardware.

Bathroom stalls subject to the Americans with Disabilities Act (ADA) must have doors that are self-closing. To achieve such a self-closing door, some doors use springs. However, these springs are subject to failure. Moreover, for non-ADA bathroom stall doors, there is a demand for a door that returns to a specific, non-closed position. This position is typically 15°-20° with respect to the closed position, leaving enough of an opening for a person to easily determine whether the stall is occupied or not.

One embodiment of the present invention is a gear hinge assembly including a pair of mating hinge members and one or more bearing blocks. Each bearing block has one or more non-perpendicular—with respect to the longitudinal axis—end edge surfaces. This provides a low friction device which makes it easier to open and close the door, as well as reducing wear of the bearing blocks and gear hinge cutout edges. The end edges of the bearing blocks are preferably helically shaped. In addition, the gear segment portions may have ends which are shaped and sized to mate with the end edges of the bearings. Such a configuration results in a self-closing door.

A device such as a spring plunger may be used to hold the door open a desired amount so a person can easily see if a bathroom stall is occupied. The force of the spring in the spring plunger can easily be overcome to close the stall door.

Other advantages, objects and/or purposes of the invention will be apparent to persons familiar with constructions of this general type upon reading the following specification and inspecting the accompanying drawings.

DETAILED DESCRIPTION OF THE PREFERRED EMBODIMENTS

Figure 3:
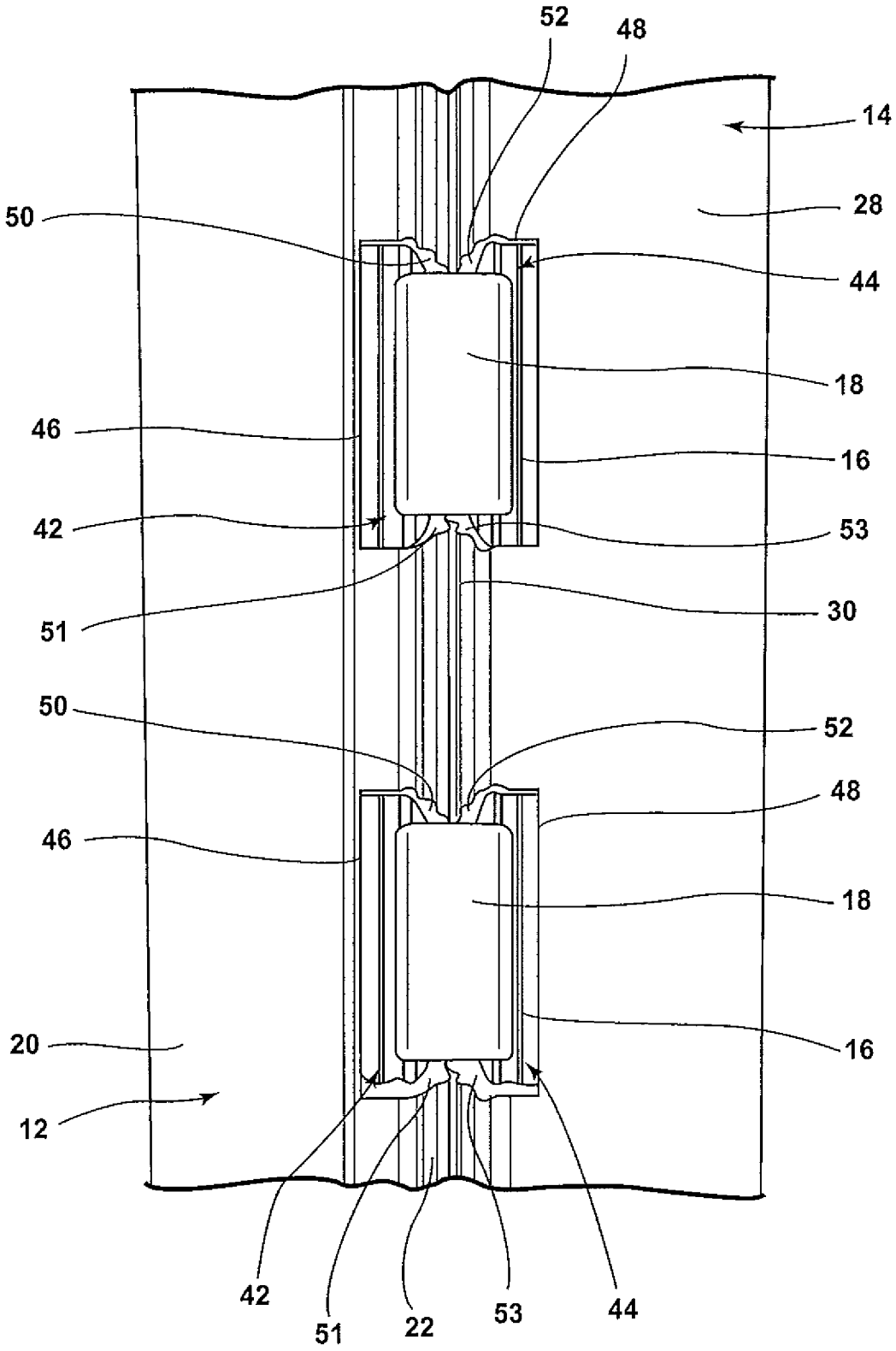
FIG. 3 is an elevational view of a portion of the gear hinge assembly of FIG. 1.

For purposes of description herein, the terms "upper," "lower," "right," "left," "rear," "front," "vertical," "horizontal," and derivatives thereof shall relate to the portion of the gear hinge assembly embodiment as oriented in FIG. 3 with the front of the gear hinge assembly generally extending out of the page. However, it is to be understood that the invention may assume various alternative orientations, except where expressly specified to the contrary. It is also to be understood that the specific devices and processes illustrated in the attached drawings and described in the following description are exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
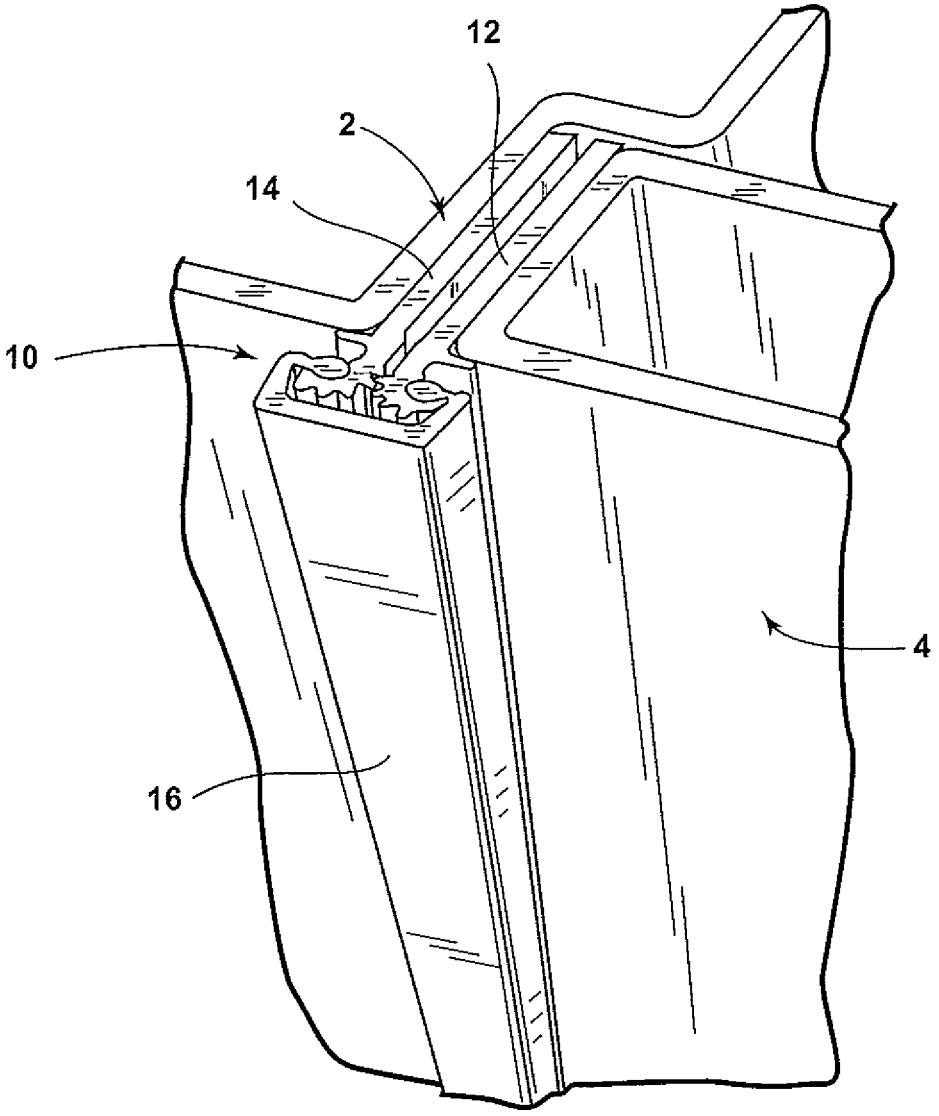
FIG. 1 is a perspective partial view of a wall containing a door frame to which a door is attached with a continuous gear hinge assembly constructed in accordance with and embodying the present invention.

As shown in FIG. 1, the door assembly may include a door jamb 2, a door 4, and a lengthwise gear hinge 10. The gear hinge 10 includes a first hinge member 12, a second hinge member 14, a hinge cap 16, and one or more bearings 18 (see FIGS. 2-3).

Figure 2:
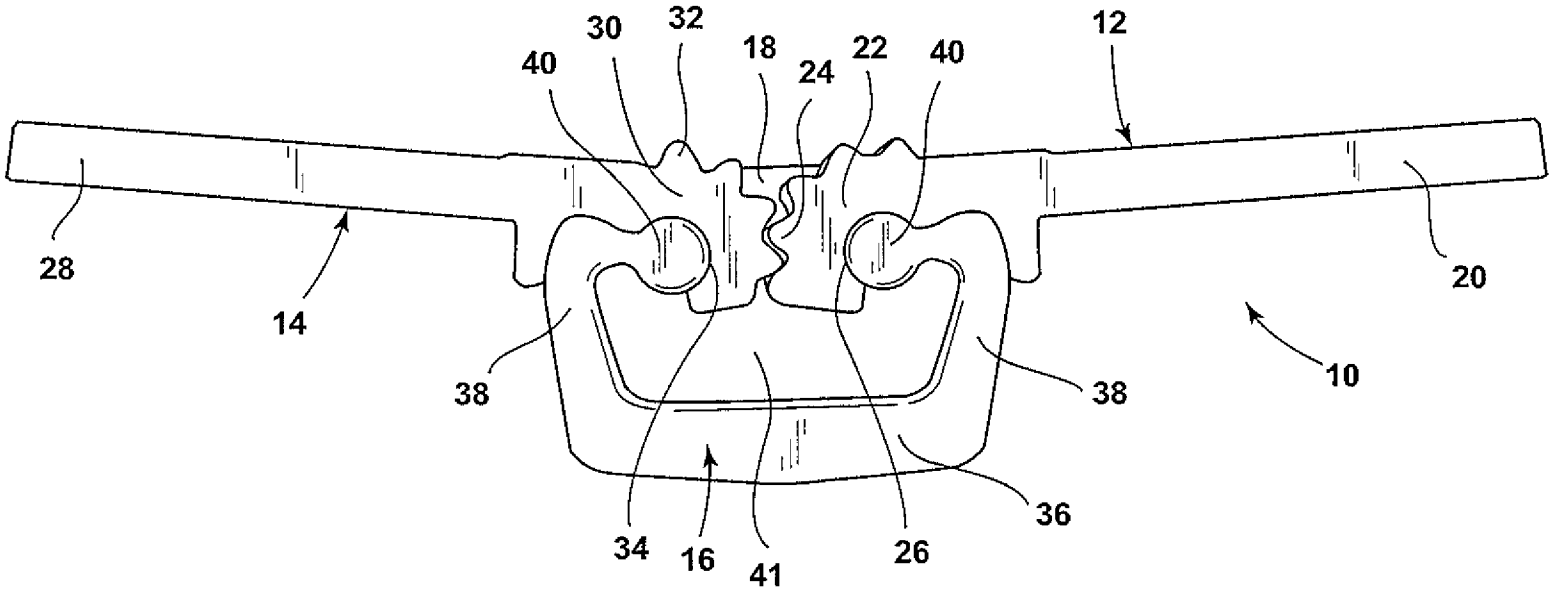
FIG. 2 is a top plan view of a portion of the gear hinge assembly of FIG. 1.

Referring now to FIGS. 2-3, the first hinge member 12 includes an elongated leaf 20 and one or more gear segments 22 which are attached to the leaf 20. The gear segment 22 is in the shape of an arc in cross-section and includes gear teeth 24 extending from the convex edge of the gear segment 22, and a cylindrically shaped surface 26 at the concave side of the gear segment 22.

The second hinge member 14 is essentially a mirror image of the first hinge member 12, but with gear teeth positioned to mesh with the gear segment 22. Accordingly, the second hinge member 14 has an elongated leaf 28 and one or more gear segments 30 which are attached to the leaf 28. The gear segment 30 is in the shape of an arc and includes gear teeth 32 extending from the convex side of the gear segment 30, and a cylindrically shaped surface 34 at the concave side of the gear segment 30.

The gear segments 22 and 30, including the gear teeth 24, 32, of the first hinge member 12 and second hinge member 14, respectively, are sized and shaped to mesh with one another and allow pivoting rotation of one or both of the hinge members with respect to each other and with respect to the hinge cap 16. The hinge cap 16 includes a base wall 36, opposing side walls 38 extending from the base wall 36, and opposing rod-like members 40 each connected to a side wall 38. The walls 36, 38 and members 40 together create an inner channel 41. The rod-like members 40 are preferably substantially cylindrical in shape, and are sized and shaped to engage with the cylindrically-shaped surfaces 26, 34 of the first hinge member 12 and the second hinge member 14. The respective rod-like members 40 are spaced apart enough such that the gear teeth 24, 32 may mesh with one another between the rod-like members 40 and the gear segments 22, 30 may pivot about the rod-like members 40.

As shown in FIG. 3, the first hinge member 12 has spaced cutout portions 42 and the second hinge member 14 has spaced cutout portions 44. The cutout portions 42 and 44 are preferably mirror images to one another and are spaced equally along the longitudinal axis of the gear hinge 10 such that the edges of the cutout portions match longitudinally. Edges 46 define the cutout portions 42 of the first hinge member 12. The edges 46 may be any shape or configuration, but as shown are horizontal and vertical edges leading to the gear segments 22. Likewise, edges 48, which define the cutout portions 44 of the second hinge member 14, may be any shape and configuration, but as shown are horizontal and vertical flat edges leading to the gear segments 30.

The gear segments 22 have upper edge surfaces 50 and lower edge surfaces 51. The upper and lower edge surfaces 50, 51, specifically in the area of the gear teeth 24, are preferably not perpendicular to the longitudinal axis of the gear hinge assembly 10. More preferably, the upper and lower edge surfaces 50, 51 are not planar, but have a helical shape, rotating to the left as the edges extend toward the bearing 18, as the gear hinge 10 is oriented in FIG. 3. The upper edge surfaces 50 face generally downwardly, as the hinge assembly is oriented in FIG. 3. The edges 50 adjoin the upper portion of the substantially horizontal edge 46 and extend downwardly moving rearwardly. Likewise, the bottom edge surfaces 51 of the gear segment 22 adjoin the bottom portion of the horizontal edge 46 and extend upwardly as they extend rearwardly. The gear segment 30 has mirror image edge surfaces 52, 53, with respect to the edge surfaces 50, 51 of the gear segment 22, in the area of the gear teeth 32. Thus, the edges 52 adjoin the upper portion of the edges 48 and extend downwardly as they extend in the rearward direction, and the edges 53 adjoin the lower portions of the edges 48 and extend upwardly as they extend in the rearward direction. The edges 50-53 mate with the end edge surfaces of the bearings 18, which are discussed in detail below.

As shown in FIG. 3, the bearings 18 fit within the matching cutout portions 42, 44, and are positioned to engage with the edge surfaces 50-53 of the gear segments 22, 24. The bearings 18 each include an outer member 54, an inner member 56, and a medial portion 58 which connects the outer member 54 to the inner member 56 (see FIGS. 4-5). The inner member 56 resides entirely within, or substantially entirely within, the inner channel 41 of the hinge cap 16 when the gear hinge 10 is assembled. The outer member 54, inner member 56, and medial portion 58 together define a first channel 60 and a second channel 62. Both channels 60, 62 are preferably substantially cylindrically shaped and are each shaped and sized to receive a portion of a rod-like member 40 of the hinge cap 16.

The outer member 54 terminates longitudinally in end edges 64, 70. The end edge 64 has a generally flat surface that is substantially perpendicular to the longitudinal axis of bearing 18, and thus also substantially perpendicular to the longitudinal axis of the gear hinge assembly 10. The inner member 56 and medial portion 58 together define two opposing non-perpendicular surfaces at each end edge of the bearing block 18. The surfaces 66, 68 at a first end abut one another, and are preferably mirror images of one another. The end edge surfaces 66, 68 also abut the outer member end edge surface 64. It is contemplated that the inner member 56 and the medial portion 58 could define a single surface or more than two surfaces at each end edge. The opposing end of the bearing block 18 preferably has identical end edge surfaces. Thus, the end edge surface 70 of the outer member 54 of the bearing block 18 is substantially perpendicular to the longitudinal axis of the bearing block 18. In addition, the opposing end edge preferably has a first end edge surface 72 and a second end edge surface 74, both defined by the inner member 56 and the medial portion 58, and both of which are preferably substantially non-perpendicular to the longitudinal axis of the bearing block 18 and when installed to the gear hinge assembly 10.

Figure 4:
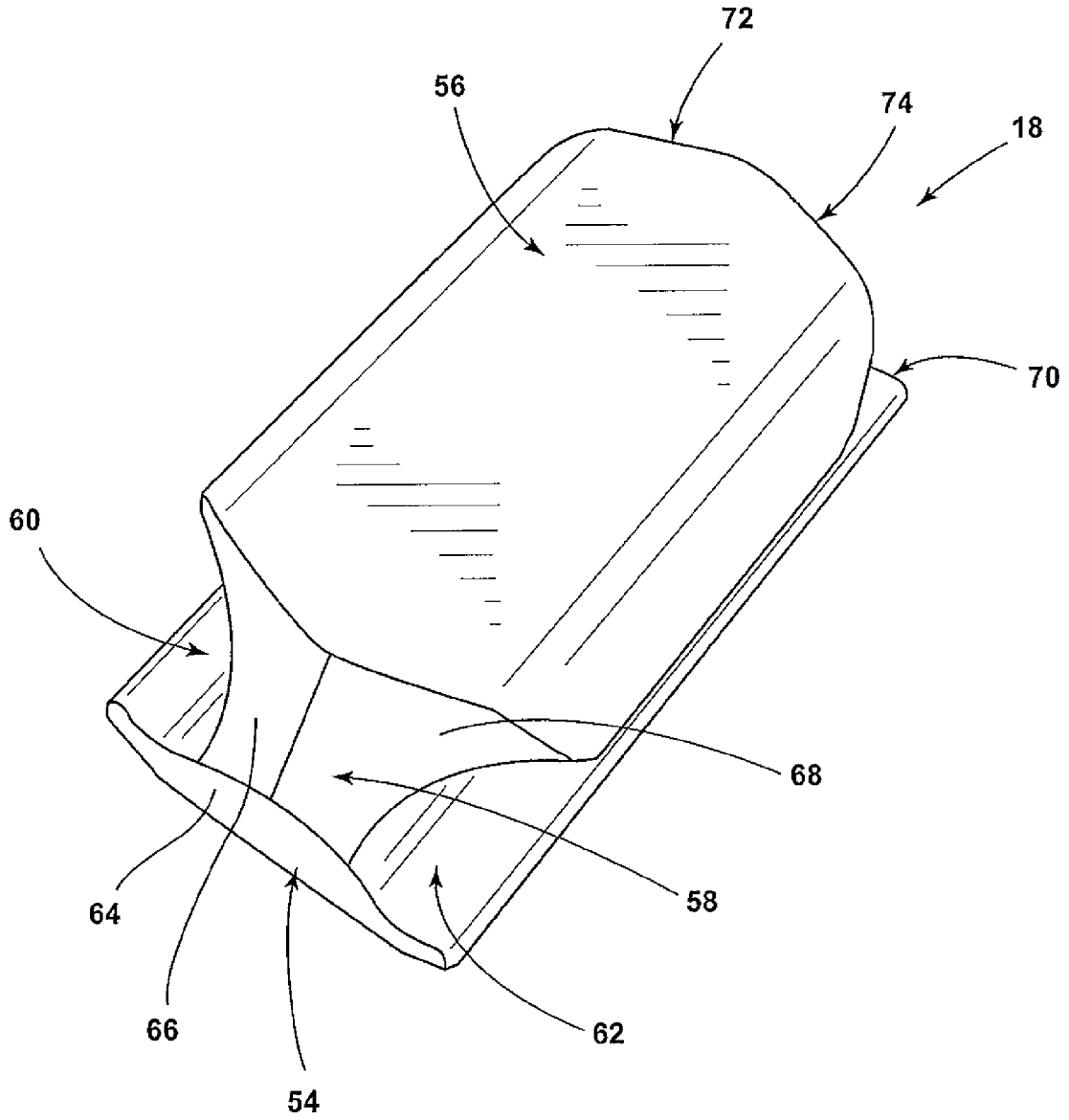
FIG. 4 is a perspective view of the bearing of the gear hinge assembly of FIG. 1.
Figure 5:
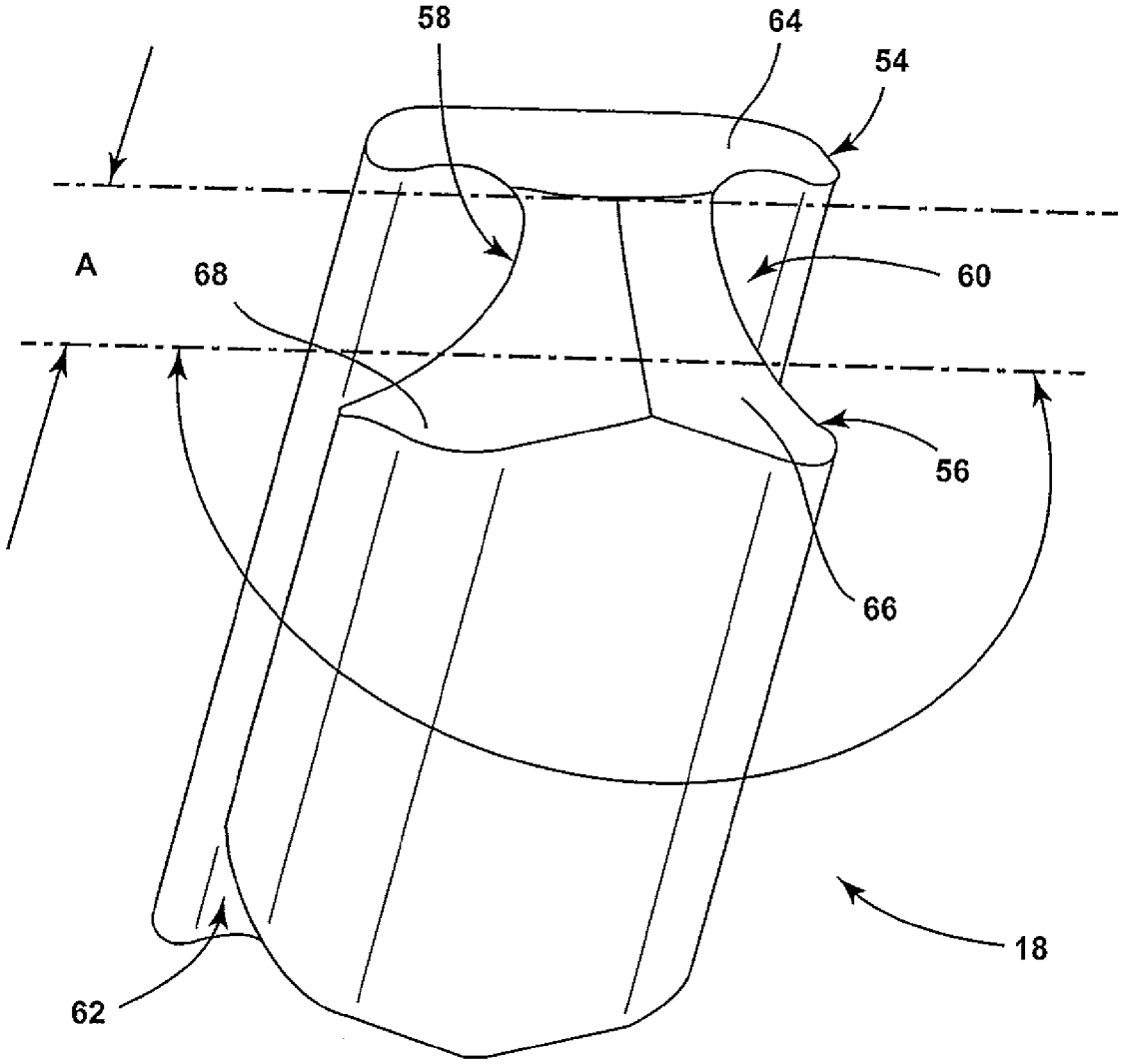
FIG. 5 is a rear perspective view of the bearing of the gear hinge assembly of FIG. 1.

The non-perpendicular end edge surfaces 66, 68, 72, 74 are preferably not flat, more preferably tapered, and most preferably helical in shape. The helical end edge surfaces 66, 68, 72, 74 have a change in elevation per rotation of between about 0.0625 inches per 180° (approximately 0.000347 inches per degree) to about 0.875 inches per 180° (about 0.00486 inches per degree). Most preferably, the change in elevation per rotation is about 0.300 inches per 180° (0.00167 inches per degree). The "elevation" is the distance that the end edge surface extends in the direction of the longitudinal axis of the bearing block 18, an example of which is depicted by the letter A in FIG. 5. The end surfaces 50, 52 of gear segments 22 and 24, respectively, are mirror images with respect to the end edge surfaces 66, 68, 72, 74, as shown in FIG. 4. In such a configuration, when installed as part of a door, the door will automatically close due to gravity and the helical nature of the end edges of both the gear segments 22, 24, and the edge surfaces 66, 68, 72, 74 of the bearings 18.

Figure 6:
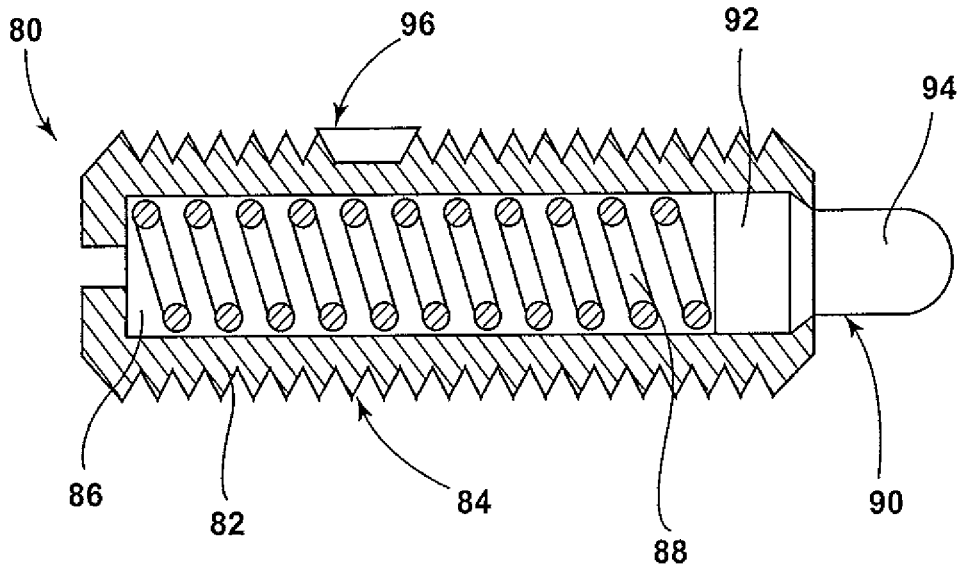
FIG. 6 is an elevational cross-sectional view of a spring plunger that may be used with the door assembly of FIG. 1.

The door assembly may also include a spring plunger 80. The spring plunger 80 is used to hold an automatically closing door open a desired amount. An embodiment of such a spring plunger is shown in FIG. 6.

The spring plunger 80 includes a housing 82 which has threads 84 on its exterior. The housing has a hollow interior 86. A coil compression spring 88 resides within the hollow interior 86. At one end of the housing 82 is a plunger member 90. The plunger member 90 includes an inner cylindrical member 92, which resides within the hollow interior 86 and has an outer diameter that is slightly smaller than the diameter of hollow interior 86. Connected to the inner cylindrical member 92 is an outer member 94, at least a portion of which is disposed outside of the housing when the spring plunger 80 is in the fully extended state. The spring plunger also may include a patch 96, preferably made of a material such as a nylon, for extra stability when the spring plunger is attached to another item.

Figure 7:
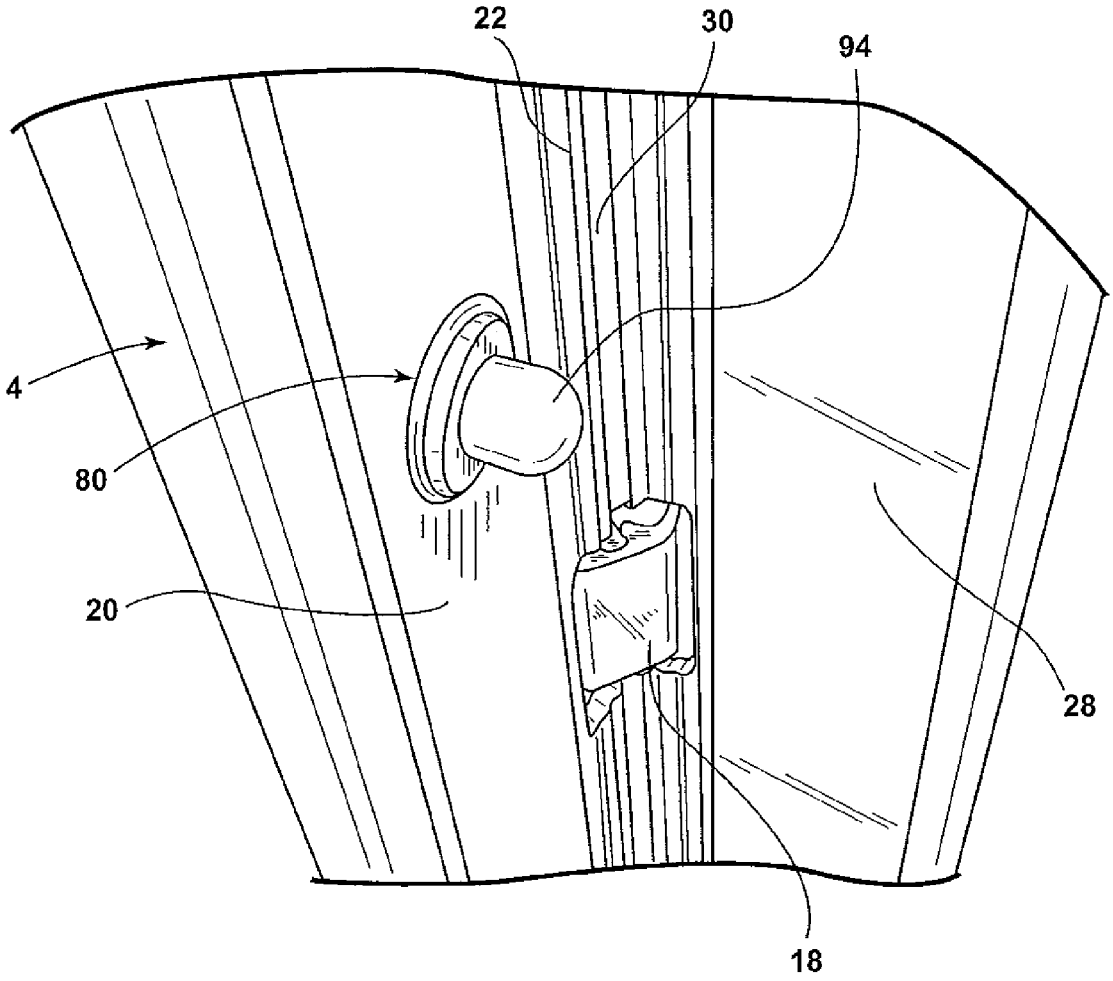
FIG. 7 is a perspective view of a portion of a stall door assembly including the gear hinge assembly of FIG. 1 and the spring plunger of FIG. 6.

The spring plunger 80 may be attached to either the door jamb 2 or the door 4, through a leaf 20 or 28 in the gear hinge 10, positioned in such a way to contact the other of the door jamb 2 or door 4 when the door 4 is being closed. FIG. 7 shows an embodiment with a spring plunger 80 attached to an edge of a door 4. In this embodiment, which includes the gear hinge assembly 10 described above, the door 4 will automatically move toward the closed position, but will remain open a desired amount (determined by the length of the plunger outer member 94), such as 15° to 20° from the closed position. A user can easily close the door, as only a small force is needed to overcome the biasing force of the coil compression spring 88.

What is claimed is:

1. A hinge assembly comprising:

an elongated hinge cap;

a first hinge member pivotably retained by the hinge cap and having a first gear section and a first leaf;

a second hinge member retained by the hinge cap and having a second gear section and a second leaf, the second gear section engaged with the first gear section; and at least one bearing engaging the hinge cap and having a longitudinal axis, an outer body portion, an inner body portion, and a medial member connecting the outer body portion and the inner body portion, the inner body portion having a axially terminating first edge and an opposing axially terminating second edge, at least one of the first edge and the second edge having a tapered section which is engageable with at least one of the first gear section and the second gear section, the inner body portion and the outer body portion being located on and defining opposing longitudinal sides of the at least one bearing.

2. The hinge assembly of claim 1, wherein the tapered section is a helical section.

3. The hinge assembly of claim 2, wherein the helical section has a change in elevation per rotation of between about 0.0625 inches per 180° and about 0.875 inches per 180°.

4. The hinge assembly of claim 3, wherein the helical section has a elevation per rotation of about 0.300 inches per 180°.

5. The hinge assembly of claim 1, wherein both the first edge and the second edge have the tapered section.

6. The hinge assembly of claim 1, wherein the tapered section has a first tapered surface and a second tapered surface, the first tapered surface and the second tapered surface being mirror images of each other.

7. A door assembly comprising:

a hinge assembly comprising:

a first hinge member having a gear section and a first leaf;

a second hinge member having a second gear section and a second leaf, the second gear section engaged with the first gear section;

at least one bearing adjacent both the first hinge member and the second hinge member and having a longitudinal axis, an outer body portion, and an inner body portion, the inner body portion having a axially terminating first edge and an opposing axially terminating second edge, at least one of the first edge and the second edge having a section which has a surface that is non-parallel with respect to the other of the first edge and second edge, the inner body portion and the outer body portion being located on and defining opposing longitudinal sides of the at least one bearing;

a door connected to the hinge assembly; and a door jamb connected to the hinge assembly.

8. The door assembly according to claim 7, and further including a spring plunger attached to one of the door and the door jamb.

9. The door assembly of claim 7, further comprising a hinge cap with which the first hinge and the second hinge are engaged.

10. The door assembly of claim 9, wherein the hinge cap includes a first substantially cylindrical member and a second substantially cylindrical member, the first hinge rotatably engaged with the first substantially cylindrical member and the second hinge rotatably engaged with the second substantially cylindrical member.

11. The door assembly of claim 7, wherein the surface of both the first edge and the second edge is tapered.

12. A hinge assembly comprising:

a bearing having a longitudinal axis and a body portion, the body portion having a longitudinally terminating first end surface and an opposing longitudinally terminating second end surface, at least one of the first end surface and the second end surface having at least one tapered section;

a first hinge member having a first gear section and a first leaf, the first hinge member having a first cutout therein shaped and sized to receive a portion of the bearing, the first cutout being disposed at a longitudinal position, the first gear section in an area being disposed adjacent the first cutout having a first tapered edge; and a second hinge member having a second gear section and a second leaf, the second gear section engaged with the first gear section, the second hinge having a second cutout therein shaped and sized to receive a portion of the bearing, the second cutout being disposed at the longitudinal position, the second gear section in an area adjacent the second cutout having a second tapered edge, the bearing partially within the first cutout and partially within the second cutout, the at least one tapered section of the bearing positioned to be engageable with one of the first tapered edge and the second tapered edge.

13. The hinge assembly of claim 12, wherein both the first end surface and the second end surface have the at least one tapered section.

14. The hinge assembly of claim 13, wherein the first gear section in the area of the first cutout has a third tapered edge.

15. The hinge assembly of claim 14, wherein the second gear section in the area of the second cutout has a fourth tapered edge.

* * * * *